US005596341A

United States Patent [19]

Miller

[11] Patent Number: 5,596,341

[45] Date of Patent: Jan. 21, 1997

[54] DISPLAY ARRANGEMENT

[75] Inventor: Roland G. Miller, New Milford, Conn.

[73] Assignee: Pitney Bowes Inc., Stamford, Conn.

[21] Appl. No.: 9,430

[22] Filed: Jan. 27, 1993

Related U.S. Application Data

[63] Continuation of Ser. No. 695,171, May 3, 1991, abandoned.

[51] Int. Cl.[6] ..... G09G 3/18; G09G 5/00

[52] U.S. Cl. ..... 345/52; 345/4

[58] Field of Search ..... 340/716, 762, 340/765, 784, 815.44, 815.45; 359/48; 345/82, 39, 38, 83, 46, 50, 52, 4, 5

[56] References Cited

U.S. PATENT DOCUMENTS

| | | | |
|---|---|---|---|
| 3,863,436 | 2/1975 | Schwarzschild et al. | 340/765 |
| 4,385,461 | 5/1983 | Wingfield | 400/711 X |
| 4,573,766 | 3/1986 | Bournay, Jr. et al. | 359/48 |
| 4,720,704 | 1/1988 | Baeger et al. | 340/716 |
| 4,748,444 | 5/1988 | Arai | 340/765 |
| 4,959,642 | 9/1990 | Sharples | 340/765 X |
| 5,008,658 | 4/1991 | Russay et al. | 340/784 |
| 5,008,788 | 4/1991 | Palinkas | 362/231 |
| 5,030,943 | 7/1991 | Anglin | 340/716 |

FOREIGN PATENT DOCUMENTS 3111886 5/1991 Japan .

*Primary Examiner*—Richard Hjerpe
*Assistant Examiner*—Kara Farnandez Stoll
*Attorney, Agent, or Firm*—Angelo N. Chaclas; Charles G. Parks, Jr.; Melvin J. Scolnick

[57] ABSTRACT

A display device has a reverse polarity LCD panel separated from a cavity by a light diffuser. A plurality of LEDs mounted in said cavity are interconnected to a common constant current source.

2 Claims, 1 Drawing Sheet

DISPLAY ARRANGEMENT

This application is a continuation of application Ser. No. 07/695,171, filed May 3, 1991, now abandoned.

FIELD OF THE INVENTION

This invention relates to a display arrangement, and is especially directed to the provision of an improved LCD display panel. While the invention is especially adapted for use as a display for a postage meter, it will be apparent that the invention is not limited to this specific application.

BACKGROUND OF THE INVENTION

In the past, yellow displays have been frequently been employed for the displays of postage meters. The color yellow has been found to be necessary for such displays in order to enable the displays to be visible by an operator in a dark environment as well as in the presence of bright sunlight or other light.

While displays of this type may employ LEDs arranged to visibly display a plurality of characters, a display of this type requires a relatively large amount of power. In addition, when the LEDs are of a specific color, such as yellow, it is necessary to color match all of the LEDs, since the human eye response peaks in the yellow range. Accordingly a display of this type is expensive to produce. In addition, when LEDs are employed in a display panel, in combination a logic circuit, it may be necessary to provide a 5 volt supply for the logic circuits as well as a 3 volt supply for the LEDs.

U.S. Pat. No. 4,959,642 discloses an LCD panel wherein backlighting is provided, primarily only for low light conditions, by LEDs. In the arrangement of this patent, however, the LEDs are provided in a relatively complex circuit to be energized by the power of a source that is being measure by the LCD circuitry, to permit the conventional LCD device to be visible in low ambient light conditions.

SUMMARY OF THE INVENTION

It is therefore an object of this invention to provide an improved display, that enhances human reading capability.

Briefly stated, in accordance with the invention, an LCD panel is provided having a "reverse polarity" i.e. having a dark background with light transmitting characters. The light transmitting characters are mounted in front of a hollow cavity containing yellow emitting diodes. The light of the yellow diodes is direct to the rear of the LCD panel via a smoke screen diffuser to ensure that light passing through the LCD panel is of a constant brightness and color throughout the LCD panel.

In order to adapt the LEDs to a variety of voltage sources that may be available, they are preferably interconnected in suitable series/parallel circuits to a constant current source.

The display panel of the invention requires only microamps for driving the LCD panel itself, as opposed to the much larger currents required for LED panels employing, for example, LED 7 segment characters. The device of the present invention does not require color matching of the LEDs, and the LED circuit itself can be energized by a current/voltage raw voltage supply of, for example, 24 volt constant current supply, which may already be available in the system.

The system of the invention has been found to permit cost reductions of up to 60% in comparison with conventional LED displays, and it can be view in all ambient light conditions, from total darkness to bright sun.

BRIEF DESCRIPTION OF THE DRAWING

In order that the invention may be more clearly understood, it will now be disclosed in greater detail with reference to the accompanying drawing, wherein.

DETAILED DISCLOSURE OF THE INVENTION

Figure 1:
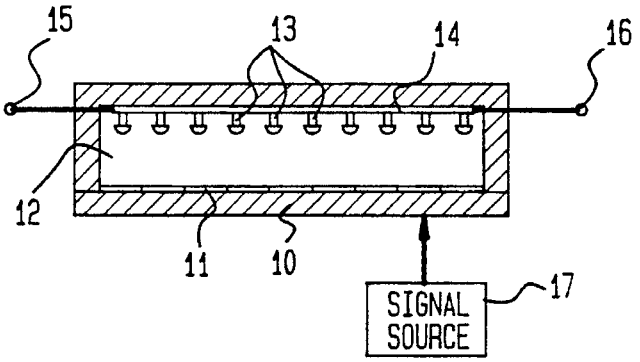
FIG. 1 is a cross sectional view of a display panel in accordance with the invention.

Referring now to FIG. 1, in accordance with a preferred embodiment of the invention, a display panel is comprised of an LCD panel 10 having, for example 10 7-segment characters with, a decimal point at each character. This display panel is formed to have a reverse polarity, i.e. so that the background of the panel is dark or opaque, and the character regions transmit light when they are energized. The LCD panel is otherwise fabricated using conventional techniques.

A smoke screen diffuser 11 is mounted at the rear of the LCD panel, and a light cavity 12 is provided at the rear of the diffuser, so that the sole source of light to be transmitted through the panel is within the cavity. A plurality of yellow LEDs 13 are mounted on a circuit board 14 within the cavity 12 to direct light toward the panel 10. The LEDs are connected in any desired series-parallel combination between the terminals 15, 16. A source 17 of signals is connected to control the energization of the LCD segments of the panel in accordance with conventional practice.

Figure 2:
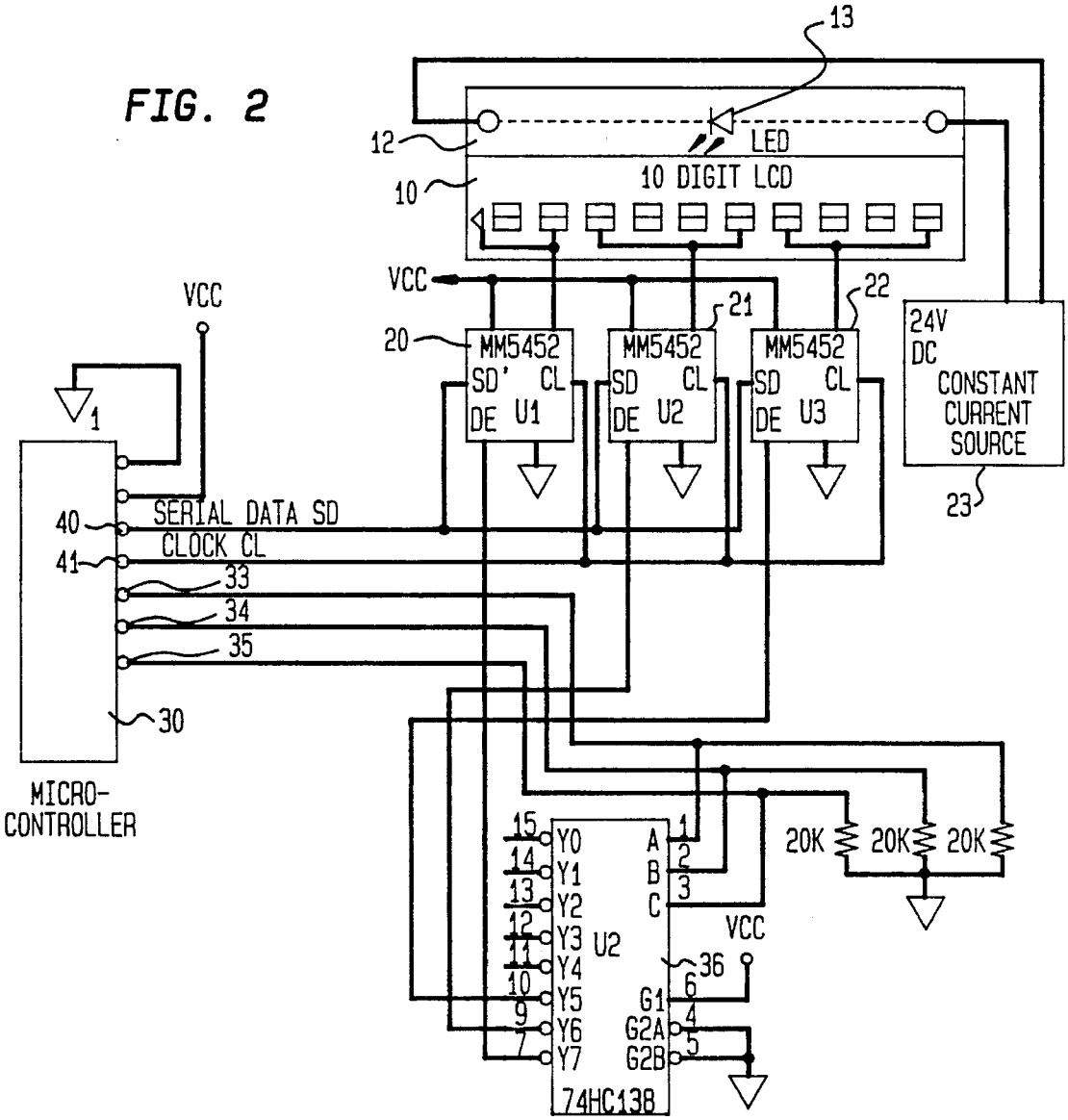
FIG. 2 is a circuit diagram of a circuit for controlling a panel of the type illustrated in FIG. 1.

In the circuit illustrated in FIG. 2, a plurality of display drivers 20, 21, 22 are connected to control the segments and digits of the LCD panel 10. For example, using type MM5452 32 segment LCD display drivers, the driver 20 is connected to control the two most significant characters of the display panel, and the drivers 21 and 22 are each connected to control four others of the characters, in conventional manner. In this circuit, a 24 volt constant current supply 23 is connected to directly energize the yellow LEDs 13. As an example, one or more groups of eight such LEDs may be connected in series with the 24 volt supply . The series/parallel connection of the LEDs may thus be adapted to permit driving the LEDs from conventional voltage sources in the equipment.

In accordance with the invention, there is no need to match the colors and brightnesses of the LEDs, since any variations in color and intensity of light viewed by way of the LCD panel is insignificant in view of the use of the diffuser 11.

A microcontroller 30 may be provided for controlling the display. For example, port terminals 40, 41 are connected to apply serial data and clock pulses, respectively to the display drivers 20–22 in conventional manner. The port terminals 33, 34, 35 of the microcontroller 30 are connected to the control inputs of a decoder/multiplexer 36, such as a type 74HC138, to permit the controlled selection of decoder output lines Y0–Y7. In this circuit, the output lines Y5, Y6 and Y7 are connected to the enable terminals DE of the display drivers 20, 21, 22, respectively, in order to enable the microcontroller to sequentially enable these drivers.

In one embodiment of the invention, the microcontroller may be programmed to control the display segments in the sequence illustrated in Table 1.

TABLE 1

| BIT # | DIGIT # | SEGMENT | BIT # | DIGIT # | SEGMENT |
|---|---|---|---|---|---|
| 1 | 1 (MSD) | A | 18 | 3 | B |
| 2 | 1 | B | 19 | 3 | C |
| 3 | 1 | C | 20 | 3 | D |
| 4 | 1 | D | 21 | 3 | E |
| 5 | 1 | E | 22 | 3 | F |
| 6 | 1 | F | 23 | 3 | G |
| 7 | 1 | G | 24 | 3 | DP |
| 8 | 1 | DP | 25 | 4 (LSD) | A |
| 9 | 2 | A | 26 | 4 | B |
| 10 | 2 | B | 27 | 4 | C |
| 11 | 2 | C | 28 | 4 | D |
| 12 | 2 | D | 29 | 4 | E |
| 13 | 2 | E | 30 | 4 | G |
| 14 | 2 | F | 31 | 4 | F |
| 15 | 2 | G | 32 | 4 | DP |
| 16 | 2 | DP | 33 | | |
| 17 | 3 | A | 34 | | |

Figure 3:
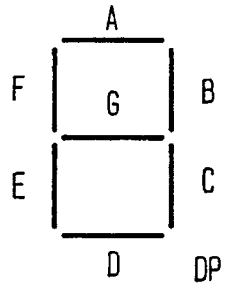
FIG. 3 is an illustration identifying the segments of a 7 segment display.

In this table, a data bit "1" or High, controls the respective segment to pass the yellow light, and a data bit "0" or Low, controls the respective segment to block the transmission of light in the respective segment. The positions of the segments are identified in FIG. 3.

The mapping of bits in the shift registers of the decoders to segments in the display conforms to the "serial Input Sequence" list of Table 1, except that the most significant two digits of the display, in a 10 segment display, are "Don't Care". However, the bit corresponding to the decimal point of the most significant digit (bit 8 of the left most shift register) may be used to control a "reset date" icon (triangle) (not illustrated) on the left end of the display, if desired, when the display panel is used in a postage meter. Other variations of the characters may also be employed.

The LEDs preferably emit yellow light of 585±5 nanometers, since this is the most sensitive region of the spectrum for human eyes. As a result, the displayed characters are visible under all ambient light conditions, from total darkness to bright sunlight.

The display panel of the present invention thus provides a display that appears to the user as an LED panel, but has a lower power dissipation than an LED panel, and is simpler and more economical to produce than an LED panel.

While the invention has been disclosed and described with reference to a single embodiment, it will be apparent that variations and modification may be made therein, and it is therefore intended in the following claims to cover each such variation and modification as falls within the true spirit and scope of the invention.

What is claimed is:

1. A display system comprising:

a multi-character segmented liquid crystal display (LCD) panel;

a smoke screen diffuser fixably mounted to the rear of the LCD panel;

a plurality of electrically interconnected yellow light emitting diodes (LED);

a first constant current power source in direct series communication with light emitting diodes;

a circuit board having said light LEDs mounted to one side of said circuit board, said circuit board being fixably mounted to said rear of the LCD panel such that said LEDs are in spaced relation to said smoke screen diffuser to define an enclosed cavity;

control means in electrical communication with each of said character segments of said liquid crystal display for selectively actuating a character segment to cause said character segment to illuminate representative of a character, wherein said control mean includes:

a plurality of display drivers, each of said drivers being in electrical communication with one or more of said respective character segments of said LCD;

a second power supply in electrical communication with each of said display drivers;

decoder/multiplexer having a plurality of output pins, respective ones of said output pins in electrical communication with a respective one of said display drivers; and, a microcontroller having;

a serial data output pin in electrical communication with each of said display drivers;

a clock pulse output pin in electrical communication with each of said display drivers; and, a plurality of output terminals in electrical communication with respective input terminals of said decoder/multiplexer.

2. A display system as claimed in claim 1 wherein said LEDs emit yellow light of 585±5 nanometers.

* * * * *